United States Patent [19]

Miller

[11] 4,155,451

[45] May 22, 1979

[54] NON-SKID PAPERBOARD TRAY

[75] Inventor: H. Glen Miller, Southfield, Mich.

[73] Assignee: Stone Container Corporation, Chicago, Ill.

[21] Appl. No.: 904,235

[22] Filed: May 9, 1978

[51] Int. Cl.[2] ..... B65D 21/02; B65D 85/62

[52] U.S. Cl. ..... 206/503; 229/32

[58] Field of Search ..... 229/32; 206/503, 427, 206/509

[56] References Cited

U.S. PATENT DOCUMENTS

| | | | |
|---|---|---|---|
| 827,124 | 7/1906 | Speer | 206/427 X |
| 3,283,992 | 11/1966 | Hanson et al. | 229/DIG. 11 |
| 3,385,429 | 5/1968 | Becker et al. | 206/503 X |
| 3,490,583 | 1/1970 | Cook | 206/503 X |
| 3,527,344 | 9/1970 | Taus et al. | 206/503 X |
| 3,638,824 | 2/1972 | Sekiguchi et al. | 206/503 X |
| 3,841,476 | 10/1974 | Elford | 229/32 X |
| 3,964,607 | 6/1976 | Wagner | 206/503 X |
| 3,982,654 | 9/1976 | Gottsegen | 206/503 X |

*Primary Examiner*—Davis T. Moorhead

[57] ABSTRACT

A disposable paperboard tray for retaining lading during transport and storage with a number of loaded trays stacked one on top of the other. The floor or bottom wall of the tray has a plurality of punched, spaced apart score lines or perforations which are not cut entirely through the floor whereby to provide a selective arrangement of protuberances on the bottom outside surface of the floor. When a plurality of trays carrying lading, such as conventional canned foods, are stacked one on top of the other, the protuberances engage the upper ends of the cans stacked in a nether tray to prevent one tray from sliding or inadvertently slipping one relative to its neighbor.

4 Claims, 4 Drawing Figures

NON-SKID PAPERBOARD TRAY

BACKGROUND OF THE INVENTION

1. Field of the Invention

This invention relates generally to disposable paperboard containers, and more particularly, to such containers having anti-skid protuberant means on the under-surface thereof to prevent a stacked tray of containers from slipping or sliding inadvertently one with respect to another.

2. Description of the Prior Art

Packaged goods such as beverages commonly are contained in cylindrical containers or cans and then arranged in aligned rows on a paperboard tray. In shipment and storage, such trays with the cans arranged thereon usually are stacked in high columns to conserve floor space in the transport vehicle or at the point of sale of the canned product.

The paperboard trays with lading thereon stacked one above another have a tendency to move or slip inadvertently with respect to each other because of the relatively low coefficient of friction between the bottom surface of one tray and the can lips upon which such tray rests. This slipping of loaded trays is of particular concern when the stacked trays with lading are transported in a vehicle; sudden stops, starts or turns of the vehicle may cause its load of trays to shift and fall resulting in possible damage to the containers and the product retained therein.

Various means are known for the provision of anti-skid container trays which avoid the aforesaid problems. For example, U.S. Pat. No. 3,490,583 discloses use of an abrasive material sprayed on the underside of the trays to prevent movement when the same are stacked. U.S. Pat. No. 3,982,654 teaches a plastic case system with the underside surface having recesses to receive the crowns of containers in an adjacent case and lock the same together to prevent movement. Similar arrangements are disclosed in U.S. Pat. Nos. 2,907,509, 3,349,943, 3,391,814 and 3,964,607. None of the aforementioned patents, however, is concerned with the provision of the expedient means of providing anti-slip surfaces for such trays by forming protuberances on the underside thereof for interaction with the tops of the lading in a next-adjacent stacked tray.

SUMMARY OF THE INVENTION

This invention provides a paperboard tray member with upstanding walls to retain rows of containers, such as cans. A plurality of perforations are provided in the floor part of the tray to form protuberances on the underside of the floor part. When a plurality of trays are stacked one on top of the other, the protuberances of one tray engage the rims of the cans in a next-below stacked tray to prevent the trays from slipping relative with respect to each other.

DESCRIPTION OF THE PREFERRED EMBODIMENT

Figure 1:
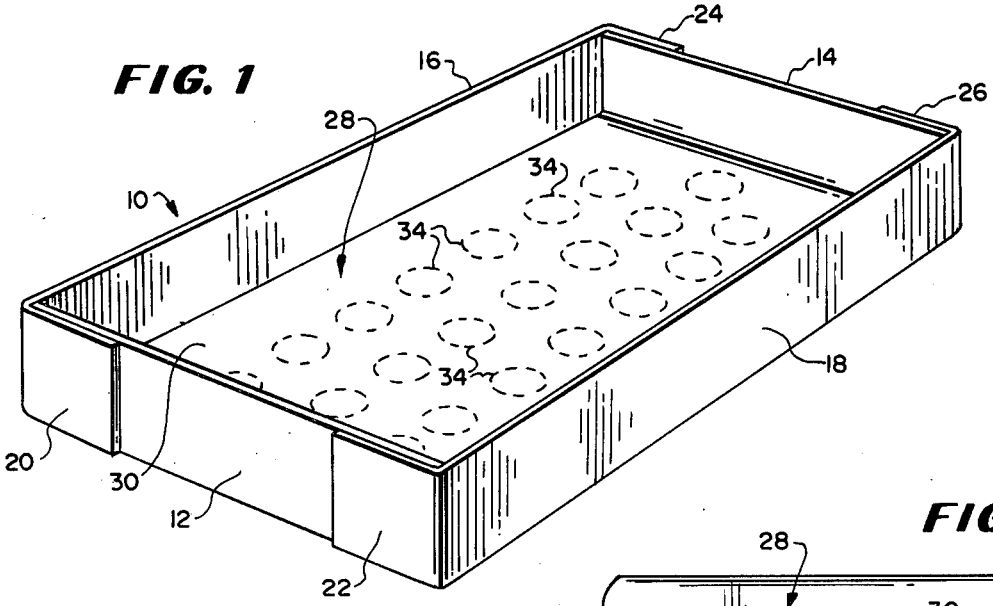
FIG. 1 is a perspective view of a tray member with perforations in the floor thereof formed in accordance with the invention.
Figure 2:
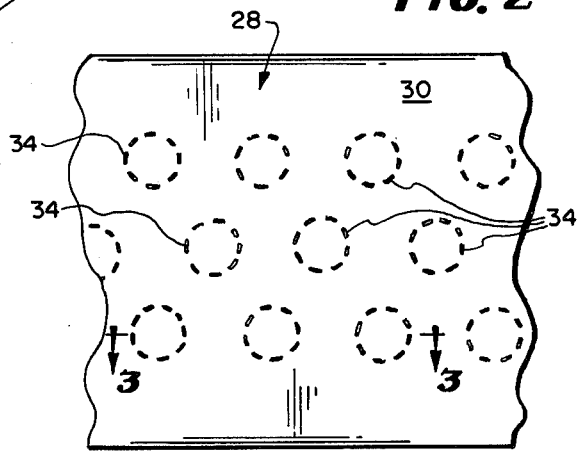
FIG. 2 is an enlarged plan view of a portion of the top surface of the floor of the tray.
Figure 3:
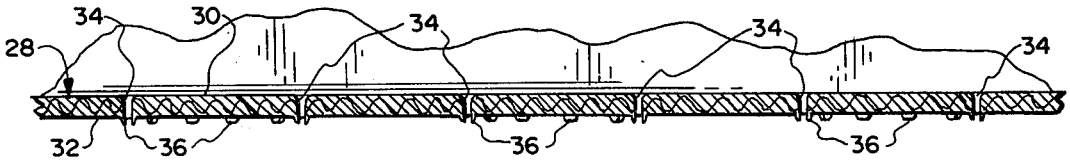
FIG. 3 is an enlarged sectional view taken along the line 3—3 of FIG. 2 in the direction indicated generally and showing the protuberances formed on the underside of the tray.

As illustrated in FIG. 1, a paperboard tray 10 having side flaps 12, 14, 16 and 18 is maintained in erected configuration by securement of tabs 20, 22, 24 and 26 in a conventional manner, such as with adhesive. The erected tray includes side walls formed by the flaps 12 through 18 and a floor or bottom wall 18 having a top surface 30 and a bottom surface 32.

The floor 28 is provided with perforations formed preferably prior to erection of the tray 10. The perforations 34 are formed in the floor by punching cuts through the top side 30 such that the paper fibers resulting from the punched parts protrude from the bottom side 32 to form protuberances 36 on said bottom side. The cuts through the floor 28 are not clean cuts so that the fibers forming the protuberances 36 remain connected so that they protrude from the bottom side 32.

In the preferred embodiment, the perforations 34 are arranged in a series of circular configurations spaced intermittently throughout the area of the floor 28, but other arrangements and configurations of the perforations may be used to produce a somewhat random arrangement of protuberances 36 on the bottom side 32 of the tray 10. The perforations may be produced by a steel die (not shown) engaged against top side 30 while the bottom side 32 rests on a rubber platen to permit the fibers cut by the die to move generally outwardly of the bottom side 32.

Figure 4:
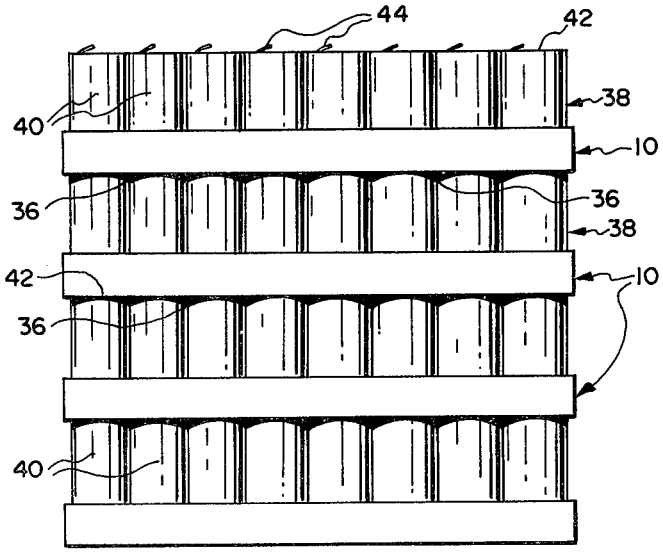
FIG. 4 is a plan view of a plurality of trays loaded with cylindrical containers and stacked one above the other.

After tray 10 is formed with protuberances 36, the tray is loaded with lading 38 which may be canned goods such as beverage cans 40 having upper ends or tops 42 which may be opened by tabs 44 provided thereon. The cans 40 are arranged in rows on the tray 10 and a plurality of loaded trays will be stacked for shipment or storage as shown in FIG. 4. In the stacked arrangement, the protuberances 36 on the bottom side of each tray engage the upper ends 42 of the cans 40 stacked in a nether tray. The protuberances, along with the weight of the cans, cooperate to prevent one tray from slipping relative to its neighbor because the protuberances engage either the rim of a can or the pull tab 44 thereof. The result is that the coefficient of friction between the bottom side 32 of a tray and the tops of the cans 40 is increased to provide a non-skid tray for preventing the stack of trays from slipping one with respect to the other.

It is to be understood that while the drawing illustrates the invention for use with trays 10 loaded with cylindrical cans, other types of lading may be carried in the trays with the same advantages of the invention being obtained. For example, the trays may be loaded with bottles in which instance the protuberances 36 would engage against the tops of such bottles to prevent slipping of one tray with respect to the other.

I claim:

1. A paperboard tray for retaining lading between upstanding walls of the tray, the lading having upper ends extending above the walls and presenting a non-planar supporting surface for the positioning thereon of a similar lading-loaded tray in a stack, said tray comprising, a floor member between the walls, the floor having a top surface upon which the lading rests and a bottom surface, a plurality of integral fiber-like protuberant means on the bottom surface of and extending from said surface whereby in a stack of such trays the protuberant means of one tray engage upper ends of the articles in the next lower tray in a stack of such trays to prevent one tray from slipping inadvertently relative to the other, and in which said protuberant means are formed as parts of perforations in said top surface extending toward said bottom surface and projecting downwardly therefrom.

2. A paperboard tray as claimed in claim 1 in which the means are protuberances arranged in a plurality of spaced apart, closed geometric formations upon the bottom surface.

3. A paperboard tray as claimed in claim 1 in which the lading is a plurality of cans and the protuberant means engage the rims of said cans.

4. A paperboard tray as claimed in claim 3 in which said protuberant means are arranged in a plurality of circular formations spaced apart along said bottom surface the major extent thereof for advantageous engagement with the cans.

* * * * *